United States Patent [19]

Strausburg

[11] 4,252,060

[45] Feb. 24, 1981

[54] LABEL PRINTING APPARATUS

[75] Inventor: Larry D. Strausburg, Miamisburg, Ohio

[73] Assignee: Monarch Marking Systems, Inc., Dayton, Ohio

[21] Appl. No.: 32,392

[22] Filed: Apr. 23, 1979

[51] Int. Cl.[3] ..... B41F 1/46; B65C 11/02

[52] U.S. Cl. ..... 101/295; 101/329; 101/348; 156/384; 156/577; 156/579; 156/584; 156/DIG. 49

[58] Field of Search ..... 156/384, 541, 577, 584, 156/DIG. 49, 579; 101/295, 314, 320, 324, 329, 348, 287, 288

[56] References Cited

U.S. PATENT DOCUMENTS

| | | | |
|---|---|---|---|
| 1,070,763 | 8/1913 | Bauman et al. | 101/329 |
| 2,513,643 | 7/1950 | Griner | 101/348 |
| 3,326,124 | 6/1967 | Heil et al. | 101/348 |
| 3,798,106 | 3/1974 | Jenkins et al. | 156/384 |
| 3,890,188 | 6/1975 | Sams | 156/384 |
| 4,044,677 | 8/1977 | Hamisch, Jr. | 101/295 |
| 4,095,524 | 6/1978 | Sato | 156/384 |
| 4,100,852 | 7/1978 | Hamisch, Jr. | 101/295 |
| 4,104,106 | 8/1978 | Hamisch, Jr. | 156/384 |
| 4,116,747 | 9/1978 | Hamisch, Jr. | 156/541 |
| 4,119,033 | 10/1978 | Sato | 101/295 |
| 4,149,462 | 4/1979 | Sato | 156/384 |

*Primary Examiner*—Michael G. Wityshyn
*Attorney, Agent, or Firm*—Jacox & Meckstroth

[57] ABSTRACT

A hand held portable labeler includes a housing enclosing a movable print head, and the housing has a pivotal cover section which covers the print head. A molded plastic frame is pivotally supported by the cover section and has spaced U-shaped bearing surfaces for receiving the end journals of an ink roller positioned to apply ink to the selected printing characters of the print head. The journals are confined in the bearing surfaces by spaced arms of a molded plastic retainer pivotally supported by the frame and releasably secured by a finger depressable positive latch so that the ink roller may be quickly and conveniently replaced without contacting the ink applying surface of the roller.

9 Claims, 4 Drawing Figures

LABEL PRINTING APPARATUS

BACKGROUND OF THE INVENTION

In a hand held portable label printing apparatus or labeler, for example, of the type disclosed in U.S. Pat. Nos. 4,100,852 and 4,116,747 which issued to the assignee of the present invention, a series of pressure sensitive labels are carried by a web and are successively advanced over a platen where each label is printed with predetermined information by a set of selectable endless printing bands forming part of a movable print head. After each label is printed, the carrier web is advanced around a delaminator where the printed label is peeled from the carrier web for application to an article by means of an applicating back-up roller. The movement of the print head and the alternating advancement of the carrier web are produced by an indexing mechanism which is preferably actuated by a trigger forming part of the handle portion of the labeler.

In a labeler of the type generally described above, it is common to use an ink applying roller which is supported for movement across the selected printing characters in response to movement of the print head. For example, as shown in FIGS. 1 and 13 of above mentioned U.S. Pat. No. 4,100,852, the ink roller has projecting end journals which snap-fit into corresponding bearing recesses formed within the side walls of a molded plastic holder. The holder is pivotally supported for movement within an aperture formed in the side wall of the labeler housing. To replace the ink roller, the end hub portions or journals of the used roller are pulled out of the snap-fitting bearing recesses, and the journals of a new or fresh roller are snapped into the bearing recesses.

Another ink roller support assembly is disclosed in connection with FIGS. 35 and 67 of U.S. Pat. No. 4,100,852. In this embodiment, the ink roller is supported by a holder which is pivotally supported between the side walls of the labeler housing, and the holder includes spaced arms having slots which receive the end journals of the ink roller. To replace the ink roller, the slotted arms are sprung apart to remove one of the journals from its supporting slot.

Referring to the hand-held labeler disclosed in above-mentioned U.S. Pat. No. 4,116,747, the holder for the ink roller is shown in FIGS. 1, 10 and 11 and is pivotally supported by a pivotal cover section of the labeler housing. The ink roller holder has deformable or pivotal side walls (FIG. 10) which are pinched or squeezed together to release the hub portions or journals of the ink roller from corresponding holes formed within the side arm extensions of the holder. A new ink roller is inserted by gripping the cylindrical inking surface and snap-fitting the end journals into the bearing holes.

Since it is periodically necessary to replace the ink roller in a hand-held labeler after a predetermined number of labels have been printed, it is highly desirable to provide not only for a positive retention of the ink roller but also for conveniently removing a used roller and inserting a new or fresh ink roller without touching the porous inking surface of the roller. In the replacement of the ink rollers disclosed in the above-mentioned patents, it is not uncommon for the operator's fingers to contact the inking surface inadvertently, thus resulting in an ink stain or smudge on the operator's fingers or hand.

SUMMARY OF THE INVENTION

The present invention is directed to labeling apparatus which incorporates an improved holder for an ink roller and which provides for conveniently replacing the ink roller while substantially reducing the chance of the operator's fingers contacting the inking surface of the roller. In accordance with one embodiment of the invention, the ink roller holder is molded of a plastics material in two sections. One section comprises a frame which is pivotally supported by the hinged or pivotal cover section of the labeler housing. The frame includes a pair of spaced ears or portions which define U-shaped bearing surfaces for receiving the corresponding end journals of an ink roller. The other section of the holder consists of an H-shaped retainer which has integrally connected arms pivotally supported by the frame. The arms have parallel spaced arm extensions which project over the U-shaped bearing surfaces to confine the end journals of the roller within the bearing surfaces. A finger releasable latch system connects the retainer to the frame and provides for not only positive retention of the ink roller by the frame but also for convenient replacement of the roller.

Other features and advantages of the invention will be apparent from the following description, the accompanying drawing and the appended claims.

DESCRIPTION OF THE PREFERRED EMBODIMENT

Figure 1:
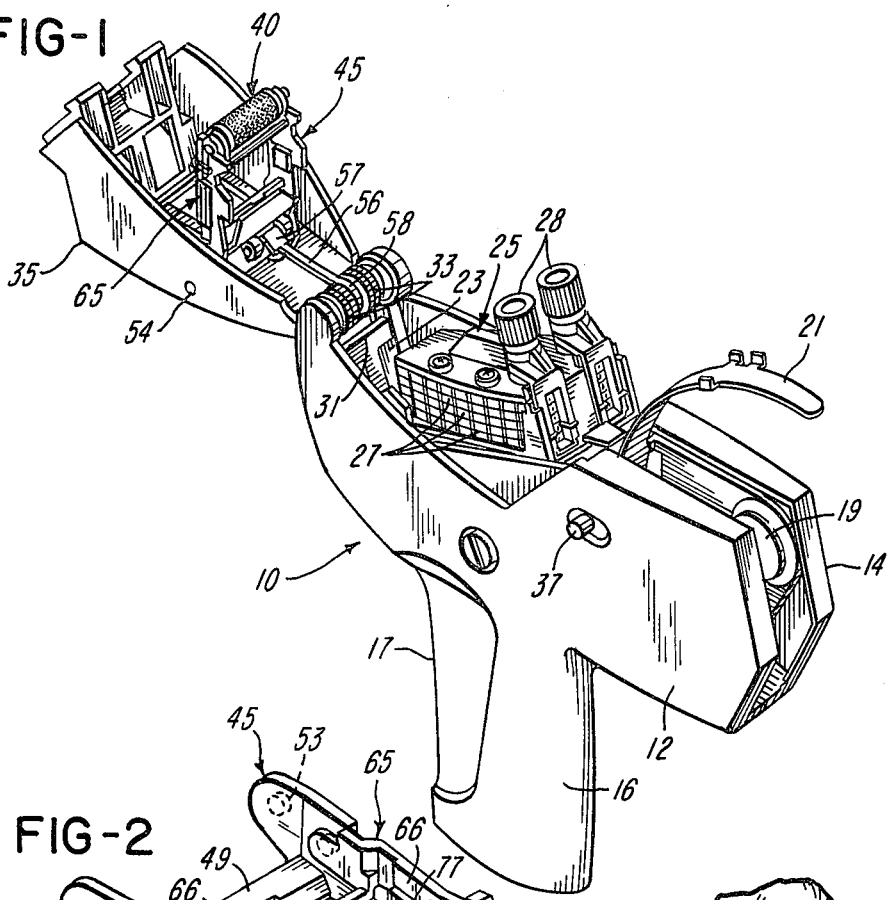
FIG. 1 is a perspective view of a hand-held labeler having a print head cover section shown in its open position and illustrating an ink roller holder constructed in accordance with the present invention.

The hand-held labeler illustrated in FIG. 1 incorporates a housing 10 which includes two mating side sections 12 and 14 which are preferably molded of a plastics material. The housing also includes a handle portion 16 having a finger operated trigger actuator 17. The specific construction of the housing 10 and the components enclosed therein are described in above-mentioned U.S. Pat. Nos. 4,100,852 and 4,116,747. The labeler is adapted to receive a supply of pressure sensitive labels which are carried by a web and wound to a roll (not shown) inserted between the opposing freely rotatable core or hub elements 19. A molded plastic leaf spring 21 guides the strip of labels into the labeler, and the strip is directed upwardly across the inner surface of a flat platen 23 where the labels are successively printed by the reciprocating movement of a print head 25. The print head is illustrated in the form of a dual line printing head, but may also be in the form of a single line printing head. Each line of printing is selected by individually positioning a set of movable endless flexible printing bands 27 through adjustment of corresponding band setting units 28.

As disclosed in the above-mentioned patents, after each pressure sensitive label is printed on the platen 23 by movement of the print head 25 in response to retraction of the trigger 17, the label strip is advanced by a predetermined increment when the trigger 17 is released. The printed label is peeled from the carrier web at a peel edge 31 where the carrier web reverses and is directed downwardly and rearwardly through the labeler and around a ratchet type indexing drive wheel enclosed within the housing 10. As each printed label is fed past the peel edge 31, the label is positioned to be applied to an article by a set of applicating rollers 33.

In a manner as illustrated in above-mentioned U.S. Pat. No. 4,116,747, the print head 25 is enclosed or covered by a molded plastic cover section 35 which is hinged or pivotally connected to the mating housing sections 12 and 14. The closure or cover section 35 is retained within its closed position by a latch mechanism which is released by pulling rearwardly on a set of outwardly projecting latch actuator knobs or pins 37, as explained in above-mentioned U.S. Pat. No. 4,116,747.

In accordance with the present invention, a replaceable ink applying roller 40 includes a porous ink retaining sleeve or tube 42 which is mounted on a pair of opposing hub members 43 having corresponding outwardly projecting end shafts or journals 44. The ink roller 40 is supported and carried by a frame 45 which is molded of a rigid plastics material and includes spaced arm or side wall portions 47 integrally connected by molded cross members 49 and 51. The arms 47 include corresponding stub shafts 53 which project outwardly into correspondingly aligned holes 54 (FIG. 1) formed within the cover section 35 to provide a pivotal support for the frame 45.

Figure 2:
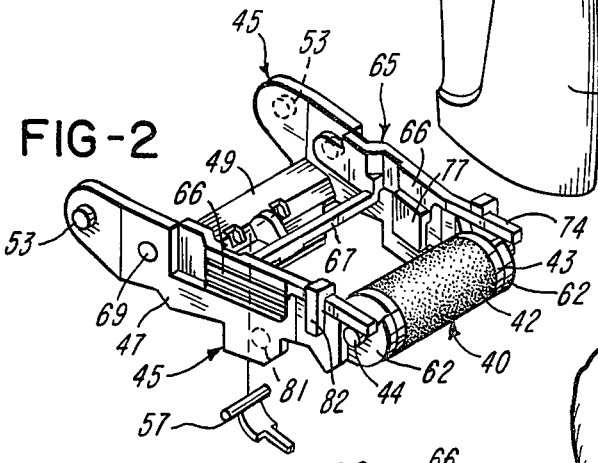
FIG. 2 is an enlarged perspective view of the ink roller and holder assembly shown in FIG. 1, with a portion of a spring element exploded away.
Figure 3:
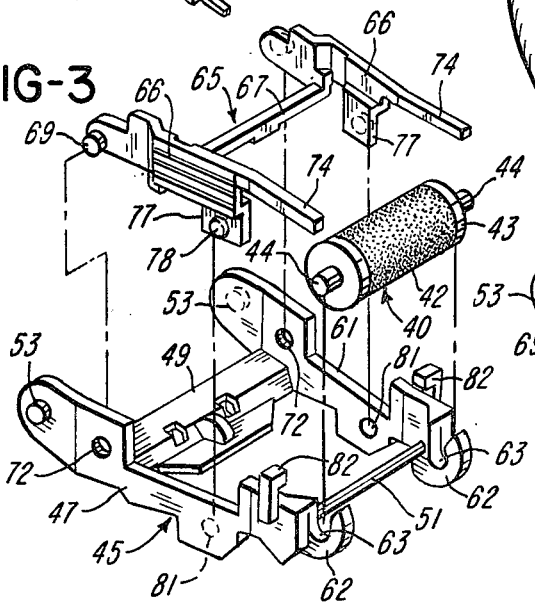
FIG. 3 is an exploded perspective view of the components forming the assembly shown in FIG. 2.

In a manner as disclosed in above-mentioned U.S. Pat. No. 4,116,747, the frame 45 is urged or biased outwardly to the position shown in FIG. 1 by a molded plastic spring element 56 having one end portion 57 (FIG. 2) pivotally connected to the cross member 49 of the frame 45. The opposite end portion 58 (FIG. 1) of the spring element 56 extends around the shaft supporting the applicator rolls 33 and engages the cover section 35. Each of the side arms 47 of the frame 45 has a rectangular recess or notch 61 and corresponding hook-shaped bearing portions 62 which define U-shaped bearing surfaces 63 for receiving and rotatably supporting the end journal 44 of the ink roller 40.

A retaining member or retainer 65 is also molded of a plastics material and includes spaced arm portions 66 which are integrally connected by a cross portion or member 67. The arm portions 66 have integrally molded stub shafts 69 which project outwardly into correspondingly aligned holes 72 formed within the side arms 47 of the ink roller frame 45 and provide a pivotable support for the retainer 65. The side arms 66 of the retainer 65 also include corresponding arm extensions 74 which project substantially parallel (FIG. 2) over the end journals 44 of the ink roller 40 and outboard of the bearing portions 62 of the support frame 45. Thus the arm portions 74 are effective to retain the journals 44 within the bearing surfaces 63 in the retaining position shown in FIG. 2. The side arms 66 of the retainer 65 also include stepped latch portions 77 which project between the arms 47 of the frame 45 and include rounded pins or studs 78 which project outwardly into correspondingly aligned cavities 81 within the side arms 47 of the frame 45 to form a snap-type detent latch connection. The arm portions 74 of the retainer 65 are also releasably locked in the retaining position (FIG. 2) by inverted L-shaped hooks 82 which are molded as integral parts of the side walls 47 and project inwardly over the tops of the arm portions 74.

Figure 4:
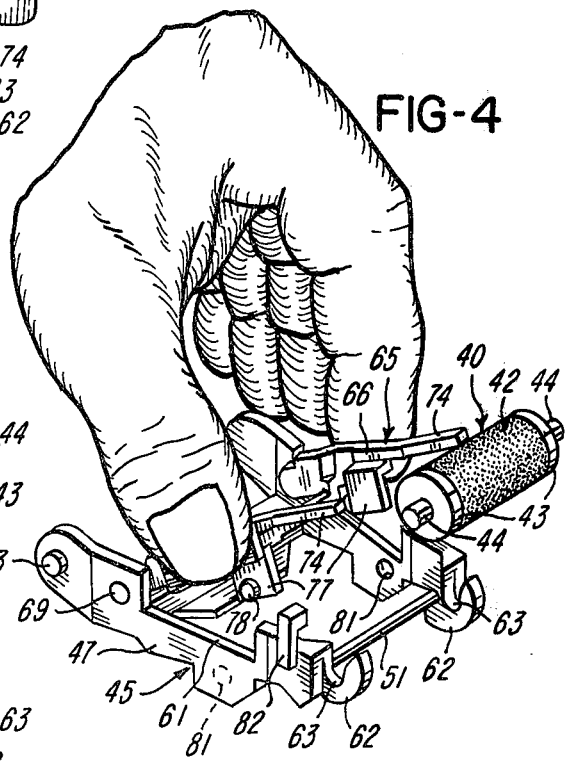
FIG. 4 is a perspective view of the holder similar to FIG. 2, and illustrating the replacement of an ink roller.

As illustrated in FIG. 4, when it is desired to replace the ink roller 40 with a new ink roller, for example, when a new roll of labels is inserted into the labeler, the side arms 66 of the retainer 65 are deformed or pressed inwardly to release the projections 78 from the cavities 81 and to release the arm portions from the hooks 82. The retainer 65 is then pivoted away from its latch position (FIG. 2) to a retracted position (FIG. 4) where the ink roller 40 is free to be dumped or disposed of into a trash receptacle. A new or fresh ink roller 40 is placed between the bearing portions 62 while the roller is being carried by pinching the end surfaces of the outwardly projecting journals 44. After the journals seat within the U-shaped bearing surfaces 63, the retainer 65 is pivoted back to its latched position (FIG. 2) where the extended arm portions 74 retain the journals 44 within the bearing surfaces 63.

From the drawing and the above description, it is apparent that a label printing apparatus or labeler constructed in accordance with the present invention, provides desirable features and advantages. As one important feature, the construction and assembly of the ink roller frame 45 and the retainer 65 provide not only for a positive holder for the ink roller 40, but also for a quick and convenient means for replacing the ink roller 40. Furthermore, the assembly enables the ink roller to be replaced without having the fingers coming in contact or close to the porous inking element 42 so that the operator of the labeler is not confronted with the nuisance of cleaning or removing ink from his or her fingers. The ink roller frame and retainer assembly is also adapted for convenient molding of a plastics material and for quick assembly into the closure or cover section 35 of the labeler.

While the frame 45 preferably includes a pair of the bearing portions 62 with U-shaped bearing surfaces 63, and the retainer 65 includes corresponding arm portions 74 to retain the journals 44 within the bearing surfaces, it is also within the scope of the invention to form one of the bearing portions with a closed circular bearing surface and to omit the corresponding arm portion 74. In such a modification, the ink roller 40 would first be tilted when it is inserted into the frame 45 so that the one journal 44 is first received in its corresponding circular bearing hole before the other journal 44 is lowered into its supporting U-shaped bearing surface 63. The same tilting would be then required to remove the ink roller.

Furthermore, while the form of labeling apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. Labeling apparatus adapted for successively printing, dispensing and applying a series of pressure sensitive labels, said apparatus comprising a housing including a handle portion, means for supporting a roll of pressure sensitive labels carried by a web, a movable print head having means for selecting predetermined printing characters to be printed on each label, actuating means including a trigger member adjacent said handle portion for moving said print head to effect successive printing of the labels on the web and for advancing the web, means for delaminating each printed label from the web in response to advancement of the web and after the label is printed, an ink roller having axially projecting journals at opposite ends, means supporting said ink roller for movement across the selected printing characters to apply ink to the characters, said ink roller supporting means including a movable frame member including spaced side walls integrally connected by at least one cross member, said frame member having spaced bearing portions forming generally U-shaped bearing surfaces positioned to receive said journals of said ink roller, a retaining member having spaced arm portions extending between said side walls of said frame member and forming latch portions, means connected to said frame member and supporting said retaining member for pivotal movement between a retaining position with said arm portions holding said journals within said bearing surfaces and a retracted position providing for free release of said journals from said bearing surfaces, releasable latch means for securing said retaining member in said retaining position on said frame member, and said latch portions are pinched together to release said latch means for pivoting said retaining member.

2. Labeling apparatus adapted for successively printing, dispensing and applying a series of pressure sensitive labels, said apparatus comprising a housing including a handle portion, means for supporting a roll of pressure sensitive labels carried by a web, a movable print head having means for selecting predetermined printing characters to be printed on each label, actuating means adjacent said handle portion for moving said print head to effect successive printing of the labels on the web and for advancing the web, means for delaminating each printed label from the web in response to advancement of the web and after the label is printed, an ink roller having axially projecting journals at opposite ends, means supporting said ink roller for movement across the selected printing characters to apply ink to the characters, said ink roller supporting means including a movable frame member with spaced side walls having spaced bearing portions forming generally U-shaped bearing surfaces positioned to receive said journals of said ink roller, a retaining member having spaced arm portions, means connected to said frame member and supporting said retaining member for pivotal movement between a retaining position with said arm portions holding said journals within said bearing surfaces and a retracted position providing for free release of said journals from said bearing surfaces, releasable latch means for securing said retaining member in said retaining position on said frame member, and said arm portions are pinched together to release said latch means for pivoting said retaining member.

3. Labeling apparatus as defined in claim 2 wherein said latch means include spaced latch portions projecting between said side walls of said frame member, and said latch portions include elements projecting outwardly into releasable engagement with said side walls of said frame member.

4. Labeling apparatus as defined in claim 2 wherein said retaining member comprises a molded plastic body having generally an H-shaped configuration.

5. Labeling apparatus as defined in claim 2 wherein said arm portions of said retaining member are disposed outboard of said bearing portions of said frame member.

6. Labeling apparatus as defined in claim 2 wherein said journals of said ink roller project axially beyond said bearing portions of said frame member to facilitate replacement of said ink roller.

7. Labeling apparatus as defined in claim 2 wherein said retaining member includes a cross member integrally connecting said arm portions and providing for slight flexing of said arm portions.

8. Labeling apparatus as defined in claim 2 wherein said latch means comprise a hook portion for releasably securing said retaining member in said retaining position.

9. Labeling apparatus defined in claim 2 wherein said latch means comprise a set of inverted L-shaped opposing hook elements secured to said side walls of said frame member and projecting over said arm portions of said retaining member.

* * * * *